US007316581B2

(12) United States Patent
Kumakura

(10) Patent No.: US 7,316,581 B2
(45) Date of Patent: Jan. 8, 2008

(54) TERMINAL FITTING AND METHOD OF ATTACHING THE SAME

(75) Inventor: Hideto Kumakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/582,986

(22) Filed: Oct. 19, 2006

(65) Prior Publication Data

US 2007/0093101 A1 Apr. 26, 2007

(30) Foreign Application Priority Data

Oct. 25, 2005 (JP) ..... 2005-309501

(51) Int. Cl.
*H01R 4/24* (2006.01)

(52) U.S. Cl. ..... 439/422; 439/877; 439/423

(58) Field of Classification Search ..... 439/422, 439/423, 877, 878
See application file for complete search history.

(56) References Cited

U.S. PATENT DOCUMENTS 3,675,180 A * 7/1972 Podmore ..... 439/877
3,696,322 A * 10/1972 Spangler et al. ..... 439/423
3,697,925 A * 10/1972 Henschen ..... 439/494
4,012,101 A * 3/1977 Damoisiaux et al. ..... 439/422
4,832,620 A * 5/1989 Yamamoto ..... 439/422
5,137,468 A * 8/1992 Murakami ..... 439/422
5,733,154 A * 3/1998 Libregts ..... 439/850
6,354,866 B1 * 3/2002 Hasegawa et al. ..... 439/422
6,375,492 B1 * 4/2002 Hio ..... 439/422
6,565,376 B2 * 5/2003 Aoki ..... 439/422

FOREIGN PATENT DOCUMENTS

EP 1 363 362 A1 11/2003

* cited by examiner

*Primary Examiner*—Tho D. Ta
(74) *Attorney, Agent, or Firm*—Kratz, Quintos & Hanson, LLP

(57) ABSTRACT

The terminal fitting includes: an electric contact part to be connected to a mating terminal fitting; and an electric wire connecting part including a bottom wall and a pair of caulking pieces rising up from the bottom wall, the pair of the caulking pieces caulking a conductor of a flat circuit body on a condition that the conductor is positioned above the bottom wall between the pair of the caulking pieces, thereby the electric wire connecting part crimping the conductor. Each caulking piece is provided with a fastening projection which projects from the caulking piece in a direction in which the pair of the caulking pieces approaches each other and prevents the conductor from coming off from between the pair of the caulking pieces.

6 Claims, 7 Drawing Sheets

TERMINAL FITTING AND METHOD OF ATTACHING THE SAME

BACKGROUND OF THE INVENTION (1) Field of the Invention

The present invention relates to a terminal fitting and a method of attaching the terminal fitting, and particularly to a terminal fitting to be attached to a conductor of a flat circuit body such as a flexible printed circuit (FPC) or flexible flat cable (FFC) and a method of attaching such a terminal fitting.

(2) Description of the Related Art

Various electronic instruments are mounted on a motor vehicle as a mobile unit. The motor vehicle includes a wiring harness for transmitting electric power from a battery and control signals from a control device. The wiring harness includes electric wires and connectors. The connector includes a housing made of electrically insulating synthetic resin and terminal fittings received in the housing and attached to ends of the electric wires.

The motor vehicle is required to have multi-functions by users. Therefore, the number of instruments mounted on the motor vehicle tends to increase. That is, the number of the electric wires in the wiring harness tends to increase, thereby making the weight and volume of the wiring harness increase.

Accordingly, it has been proposed that a flat circuit body such as a FFC or FPC is used as the electric wires in the wiring harness in order to reduce the size and weight of the wiring harness.

The flat circuit body is formed in a flat band-shape including a plurality of electric conductors having a rectangular shape in section and film-shaped coatings for coating the respective conductors. Each conductor extends straight. A plurality of the conductors are arranged in parallel to each other. The coating insulates the conductors from each other.

When the terminal fitting is attached to the conductor of the flat circuit body, for example, as shown in European Patent Application Laid-Open No. 1363362, the conductor is once bent into a shape adapted to attach the terminal fitting thereto and then the terminal fitting is attached to the conductor, so that the attaching can be carried out stably without a risk of failure in contact between the conductor and the terminal fitting.

However, in the method of attaching a terminal fitting as shown in European Patent Application Laid-Open No. 1363362, when the terminal fitting is to be attached, it is necessary to prepare a mold for forming the conductor into a shape adapted to attach the terminal fitting thereto and another mold for caulking the terminal fitting to the conductor, causing increase in the cost.

It may be considered that the terminal fitting is attached to a flat conductor without forming the conductor into a shape adapted to attach the terminal fitting thereto. However, in this case, when the terminal fitting is attached to the conductor, since the conductor is flat, a positional gap between the terminal fitting and the conductor occurs, therefore it is difficult to securely attach the terminal fitting to the conductor.

SUMMARY OF THE INVENTION

It is therefore an objective of the present invention to solve the above problem and to provide a terminal fitting and a method of attaching the terminal fitting, by which the terminal fitting can be securely attached to the conductor of the flat circuit body without increasing the cost.

In order to attain the above objective, the present invention is to provide a terminal fitting including:

an electric contact part to be connected to a mating terminal fitting;

an electric wire connecting part including a bottom wall and a pair of caulking pieces rising up from the bottom wall, the pair of the caulking pieces caulking a conductor of a flat circuit body on a condition that the conductor is positioned above the bottom wall between the pair of the caulking pieces, thereby the electric wire connecting part crimping the conductor; and preventing means for preventing the conductor from coming off from between the pair of the caulking pieces.

With the construction described above, when the pair of the caulking pieces caulks the conductor, the conductor does not come off from between the pair of the caulking pieces and a positional shift between the terminal fitting and the conductor never takes place. Therefore, even if the conductor does not have a shape according to the terminal fitting before the positioning thereof, a stable crimping can be attained, so that the number of moldings for use upon attaching of the terminal fitting to the conductor can be prevented from increasing. Accordingly, the cost can be prevented from increasing and the terminal fitting can be securely attached to the conductor of the flat circuit body.

Preferably, the preventing means consists of fastening projections, each of which projects from the caulking piece in a direction in which the pair of the caulking pieces approaches each other.

With the construction described above, since the fastening projections act as stoppers so that the conductor does not come off from between the pair of the caulking pieces, therefore the terminal fitting can be more securely attached to the conductor of the flat circuit body.

Preferably, the fastening projections are formed at both edges of the pair of the caulking pieces, each edge being on the side situated away from the bottom wall.

With the construction described above, since the conductor never comes off from between the both edges of the pair of the caulking pieces, therefore the terminal fitting can be more securely attached to the conductor of the flat circuit body.

Preferably, a distance between the fastening projections is smaller than a width of the conductor.

With the construction described above, even if a vibration takes place after the conductor is positioned above the bottom wall between the pair of the caulking pieces, the conductor never comes off from between the pair of the caulking pieces, therefore the attaching can be easy.

Preferably, a distance between the fastening projections is larger than a width of the conductor.

With the construction described above, the conductor can be inserted from between the edges of the pair of the caulking pieces, the edge being on the side situated away from the bottom wall, and can be positioned above the bottom wall after passing through between the fastening projections. Therefore, positioning of the conductor above the bottom wall can be easily carried out.

Preferably, the fastening projections are formed by bending the edges of the pair of the caulking pieces, each edge being on the side situated away from the bottom wall.

With the construction described above, the fastening projections can be formed along the edges of the caulking pieces, the edge being on the side situated away from the bottom wall. Therefore, the conductor can be inserted into between the pair of the caulking pieces along the fastening projections from the edges of the caulking pieces, the edge being on the side situated away from the electric contact part. Therefore, positioning of the conductor above the bottom wall can be easily carried out.

Preferably, the fastening projections are formed by extruding the edges of the caulking pieces in a direction in which the pair of the caulking pieces approaches each other.

With the construction described above, the fastening projections can be easily formed by extruding, thereby reducing the cost.

In order to attain the above objective, the present invention is to provide a method of attaching a terminal fitting to a conductor of a flat circuit body, the terminal fitting including:

an electric contact part to be connected to a mating terminal fitting;

a bottom wall;

a pair of caulking pieces rising up from the bottom wall; and fastening projections formed at both edges of the pair of the caulking pieces, each edge being on the side situated away from the bottom wall, each fastening projection projecting from the caulking piece in a direction in which the pair of the caulking pieces approaches each other, a distance between the fastening projections being smaller than a width of the conductor, the method including the steps of:

inserting the conductor into between the pair of the caulking pieces from between both edges of the pair of the caulking pieces, each edge being on the side situated away from the electric contact part, so as to position the conductor above the bottom wall; and caulking the conductor with the pair of the caulking pieces so as to crimp the conductor.

With the construction described above, even if a distance between the fastening projections formed on the pair of the caulking pieces is smaller than the width of the conductor, the conductor can be easily positioned above the bottom wall between the pair of the caulking pieces. Therefore, positioning of the conductor above the bottom wall can be easily carried out.

In order to attain the above objective, the present invention is to provide a method of attaching a terminal fitting to a conductor of a flat circuit body, the terminal fitting including:

an electric contact part to be connected to a mating terminal fitting;

a bottom wall;

a pair of caulking pieces rising up from the bottom wall; and fastening projections formed at both edges of the pair of the caulking pieces, each edge being on the side situated away from the bottom wall, each fastening projection projecting from the caulking piece in a direction in which the pair of the caulking pieces approaches each other, a distance between the fastening projections being larger than a width of the conductor, the method including the steps of:

inserting the conductor into between the pair of the caulking pieces from between both edges of the pair of the caulking pieces, each edge being on the side situated away from the bottom wall, so as to position the conductor above the bottom wall; and caulking the conductor with the pair of the caulking pieces so as to crimp the conductor.

With the construction described above, the conductor can be inserted from between the edges of the pair of the caulking pieces, the edge being on the side situated away from the bottom wall, and can be positioned above the bottom wall after passing through between the fastening projections. Therefore, positioning of the conductor above the bottom wall can be easily carried out.

DESCRIPTION OF THE PREFERRED EMBODIMENTS

The First Preferred Embodiment

In the following, the first preferred embodiment of the present invention will be explained with reference to FIGS. 1-11.

Figure 1:
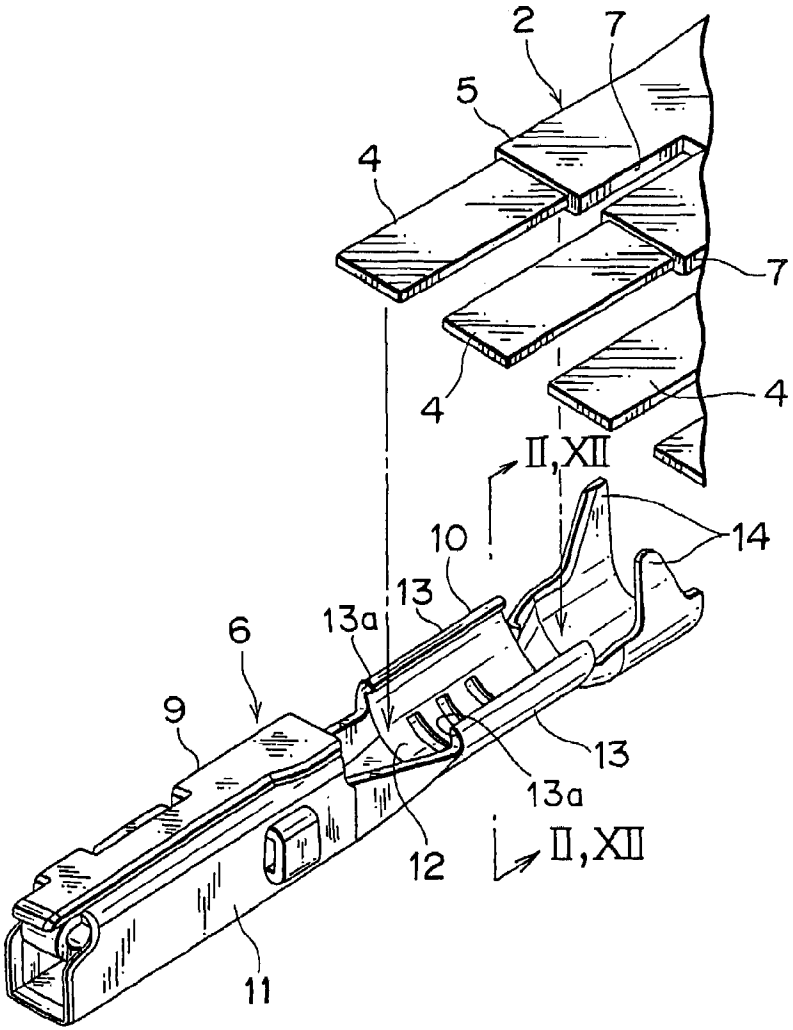
FIG. 1 is a perspective view illustrating a terminal fitting according to the present invention and a FFC to be attached to the terminal fitting.

As shown in FIG. 1, a FFC (flexible flat cable) 2 is formed in a flat belt-shape including a plurality of electric conductors 4 and coatings 5 each for coating the conductor 4.

The conductor 4 is made of electrically conductive metal. The conductor 4 contains at least copper or copper alloy. The conductor 4 is formed in a rectangular shape in its cross section. The conductor 4 extends straight. A plurality of the conductors 4 are arranged in parallel to each other.

The coating 5 is made of electrically insulating synthetic resin and formed in a flat belt-shape to coat the conductor 4. The coatings 5 electrically insulate the conductors 4 from one another. At an end part of the FFC 2, there are provided slits 7 each formed between the conductors 4 situated adjacently to each other and the coatings 5 are removed to expose the conductors 4 there.

The flat circuit body is formed in a flat belt-shape including a plurality of electric conductors and electrically insulating coatings for coating the conductors.

A terminal fitting 6 is obtained by bending an electrically conductive sheet metal and, as shown in FIG. 1, includes integrally an electric contact part 9 connecting to a mating terminal fitting and an electric wire connecting part 10 to be connected to the conductor 4 of the FFC 2.

The electric contact part 9 includes a angular tube-shaped tube part 11 and a spring piece (not shown in the figure) received in the tube part 11. In the figures (such as FIG. 1) each as an example, the tube part 11 is formed in a square tube. The spring piece biases an insertion such as a male tab of a mating terminal fitting entered in the tube part 11 toward an inner surface of the tube part 11 so as to put the insertion between the inner surface and the spring piece, so that the electric contact part 9 is electrically and mechanically connected to the mating terminal.

Figure 2:
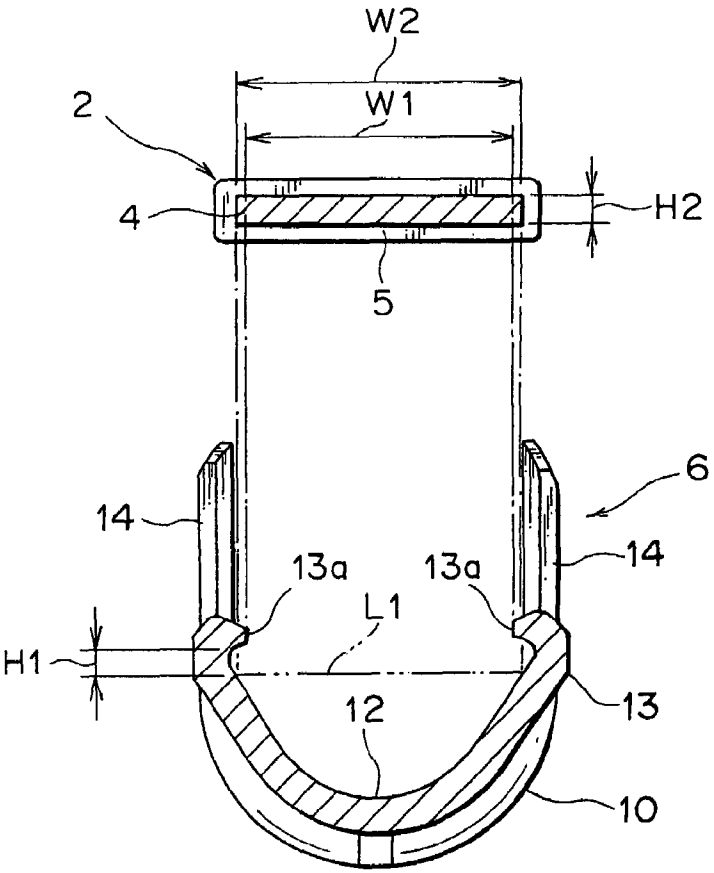
FIG. 2 is a cross sectional view of the terminal fitting and FFC taken along II-II line in FIG. 1.

As shown in FIG. 2, the electric wire connecting part 10 includes a bottom wall 12 having an arc-shape in its cross section, a pair of conductor caulking pieces 13, and a pair of coating caulking pieces 14. The bottom wall 12 continues to an outer wall of the tube part 11. An end part of the FFC 2 is positioned on a surface of the bottom wall 12. That is, the conductor 4 exposed at the end part of the FFC 2 is positioned above the bottom wall 12.

The pair of the conductor caulking pieces 13 is the pair of the caulking pieces described in the claims. The pair of the conductor caulking pieces 13 is provided at a center of the longitudinal direction of the bottom wall 12. The pair of the conductor caulking pieces 13 rises up from both ends in the width direction of the bottom wall 12.

The pair of the conductor caulking pieces 13 each is provided with a fastening projection 13*a* for preventing the conductor 4 from coming off from between the pair of the conductor caulking pieces 13. The fastening projection 13*a* projects from the conductor caulking piece 13 in a direction in which the pair of the conductor caulking pieces 13 approaches each other. The fastening projection 13*a* is the preventing means described in the claims.

The fastening projection 13*a* is formed by bending an edge of the conductor caulking piece 13, said edge being on the side situated away from the bottom wall 12. Thus, the fastening projection 13*a* is formed over the whole length of the conductor caulking piece 13 along the longitudinal direction of the bottom wall 12. As shown in FIG. 2, a distance W1 between the fastening projections 13*a* is smaller than a width W2 of the conductor 4 (that is, W1<W2).

The conductor caulking pieces 13 approach each other as approaching the bottom wall 12. With regard to portions of the conductor caulking pieces 13, said portions each being located between the fastening projection 13*a* and a position where an inner surface of the conductor caulking piece 13 crosses an alternate long and two short dashes line L1 shown in FIG. 2, a distance between the pair of the conductor caulking pieces 13 is larger than the width W2 of the conductor 4. On the other hand, with regard to portions of the conductor caulking pieces 13, said portions each being located nearer to the bottom wall 12 than the line L1 being located, a distance between the pair of the conductor caulking pieces 13 is smaller than the width W2 of the conductor 4. A height H1 from the line L1 to the fastening projection 13*a* is larger than a thickness H2 of the conductor 4.

Figure 6:
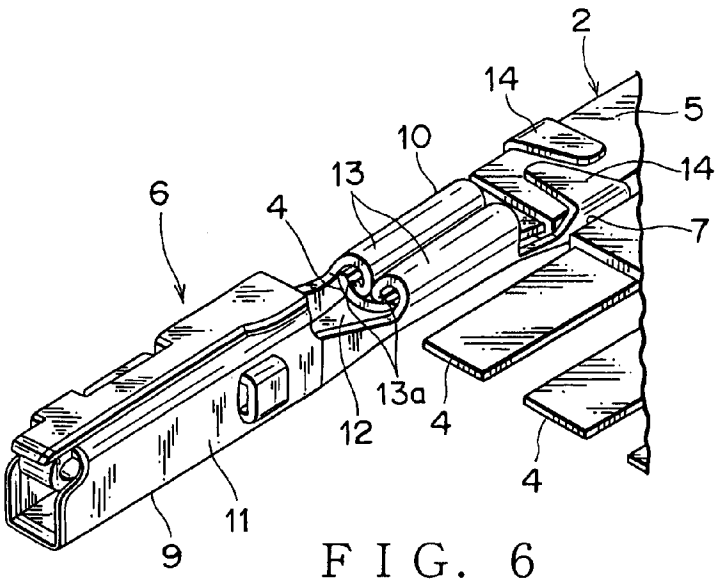
FIG. 6 is a perspective view illustrating a state when the pair of the caulking pieces of the terminal fitting shown in FIG. 4 caulks the conductor.

As shown in FIG. 6, the pair of the conductor caulking pieces 13 caulks the conductor 4 of the FFC 2 between the bottom wall 12 and the caulking pieces 13 in such a manner that each edge of the caulking piece 13 on the side situated away from the bottom wall 12 is bent in a direction in which each edge approaches the bottom wall 12.

The pair of the coating caulking pieces 14 is provided at an end part of the bottom wall 12, said end part being on the side situated away from the electric contact part 9. The pair of the coating caulking pieces 14 rises up from both ends in the width direction of the bottom wall 12. As shown in FIG. 6, the pair of the coating caulking pieces 14 caulks the coating 5 of the FFC 2 between the bottom wall 12 and the caulking pieces 14 in such a manner that each edge of the caulking piece 14 on the side situated away from the bottom wall 12 is bent in a direction in which the edge approaches the bottom wall 12.

Figure 7:
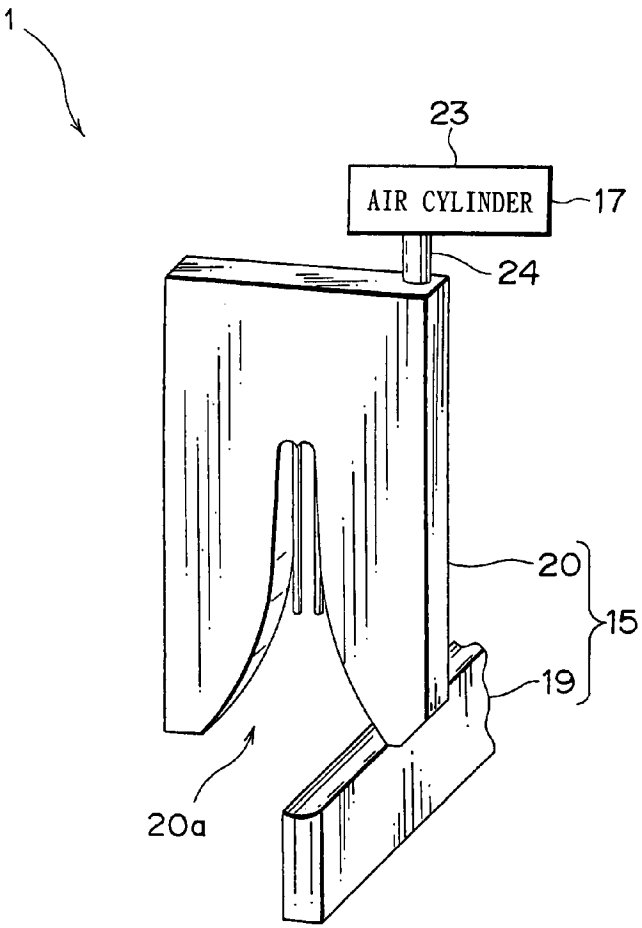
FIG. 7 is an example of a crimping apparatus which crimps the terminal fitting and the conductor shown in FIG. 1.
Figure 5:
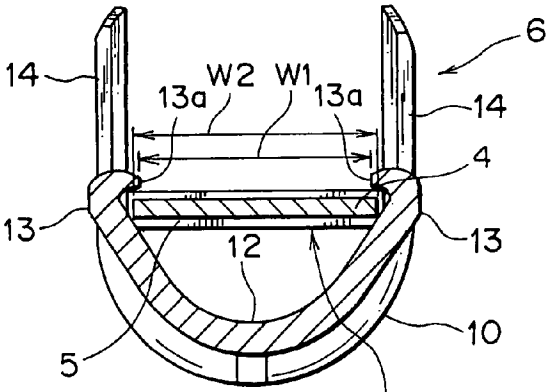
FIG. 5 is a cross sectional view of the terminal fitting and FFC taken along V-V line in FIG. 4.

By using, for example, a press-fitting device 1 shown in FIG. 7, each edge of the conductor caulking piece 13 on the side situated away from the bottom wall 12 is bent in the direction in which the edge approaches the bottom wall 12 and each edge of the coating caulking piece 14 on the side situated away from the bottom wall 12 is bent in the direction in which the edge approaches the bottom wall 12. Then, as shown in FIG. 6, the press-fitting device 1 allows the caulking pieces 13 and 14 to caulk the conductor 4 and the coating 5, respectively, so that the terminal fitting 6 is attached to the end part of the FFC 2.

As shown in FIG. 7, the press-fitting device 1 includes a device body (not shown in the figure), a caulking part 15 as caulking means, and an air cylinder 17 as a drive source. The device body is placed on a floor and so on in a plant.

The caulking part 15 includes an anvil 19 as a die and a crimper 20 as a mold. The anvil 19 is fixed on the device body. The terminal fitting 6 is placed on a surface of the anvil 19.

The crimper 20 faces the anvil 19 having a distance therebetween and is supported by the device body in such a manner that the crimper 20 can approach and leave the anvil 19. The crimper 20 is provided with a groove 20*a* formed from an edge of the crimper 20, said edge being situated near to the anvil 19, in the approaching-and-leaving direction of the crimper 20. The width of the groove 20*a* becomes small in a direction parting away from the anvil 19.

First, the terminal fitting 6 and the end part of the FFC 2 are positioned on the anvil 19 on a condition that the anvil 19 and the crimper 20 are parted from each other. Then, the anvil 19 and the crimper 20 approach each other so as to put the terminal fitting 6 and the end part of the FFC 2 therebetween, thereby allowing the caulking pieces 13 and 14 to caulk the conductor 4 and the coating 5, respectively.

The air cylinder 17 as a drive source includes a cylinder body 23 and a rod 24 which can project from and retract to the cylinder body 23. The cylinder body 23 is attached to the device body of the press-fitting device 1. The rod 24 is attached to the crimper 20. The air cylinder 17 is arranged in such a manner that the crimper 20 approaches the anvil 19 when the rod 24 extends from the cylinder body 23, while the crimper 20 leaves the anvil 19 when the rod 24 contracts toward the cylinder body 23.

In the following, it is explained how the terminal fitting 6 is attached to the conductor 4 of the FFC 2. First, as shown in FIG. 7, the terminal fitting 6 is placed on the anvil 19 on a condition that the anvil 19 and the crimper 20 are parted from each other. Then, the conductor 4 of the FFC 2 is moved in the direction of an arrow shown in FIG. 3, that is, toward the electric contact part 9, so that the conductor 4 is inserted into between the pair of the coating caulking pieces 14 from edges of the caulking pieces 14, said edges each being on the side situated away from the electric contact part 9.

Figure 3:
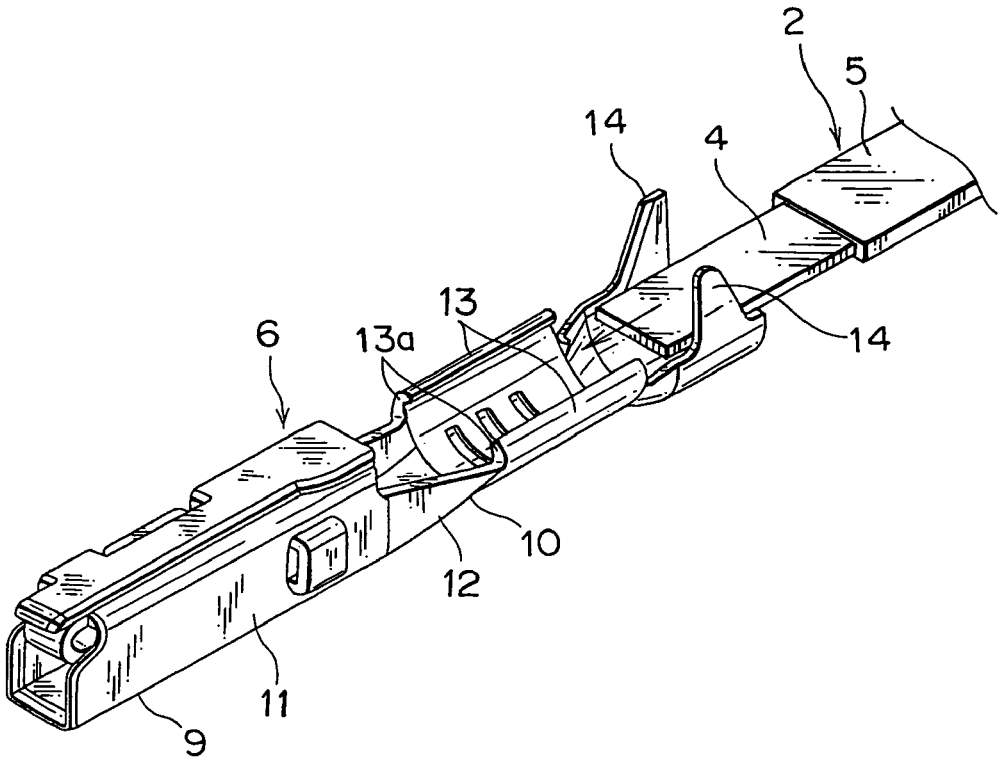
FIG. 3 is a perspective view illustrating a state before a conductor is inserted into a pair of caulking pieces of the terminal fitting shown in FIG. 1.
Figure 4:
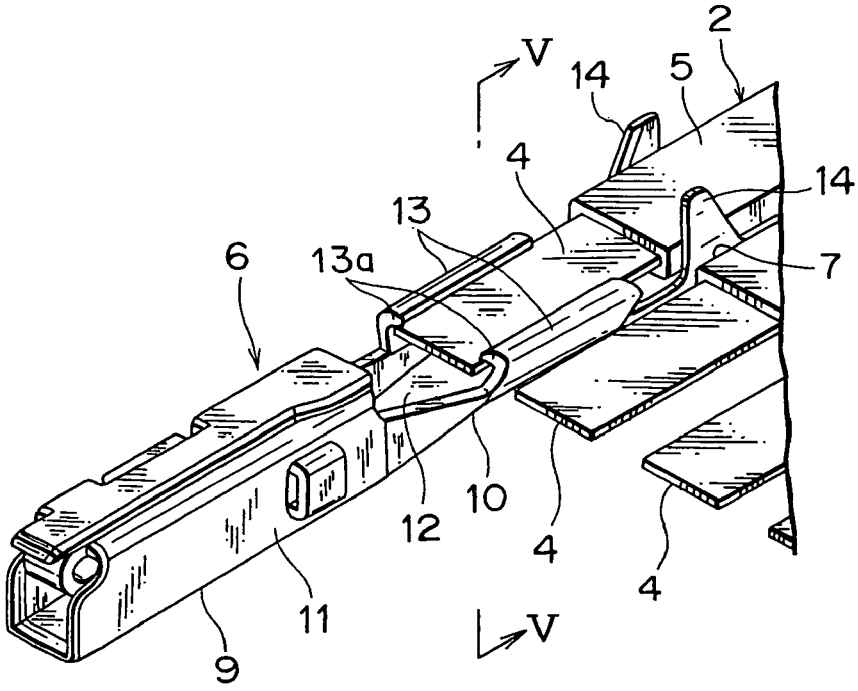
FIG. 4 is a perspective view illustrating a state when the conductor is positioned on a bottom wall between the pair of caulking pieces of the terminal fitting shown in FIG. 1.

Then, the conductor 4 is further moved toward the electric contact part 9, so that the conductor 4 is inserted into between the pair of the conductor caulking pieces 13 from edges of the caulking pieces 13, said edges each being on the side situated away from the electric contact part 9. Thereafter, the conductor 4 is further moved toward the electric contact part 9 along the fastening projections 13*a*. As a result, as shown in FIGS. 3 and 4, the conductor 4 is positioned above the bottom wall 12 between the pair of the conductor caulking pieces 13 of the terminal fitting 6.

Figure 8:
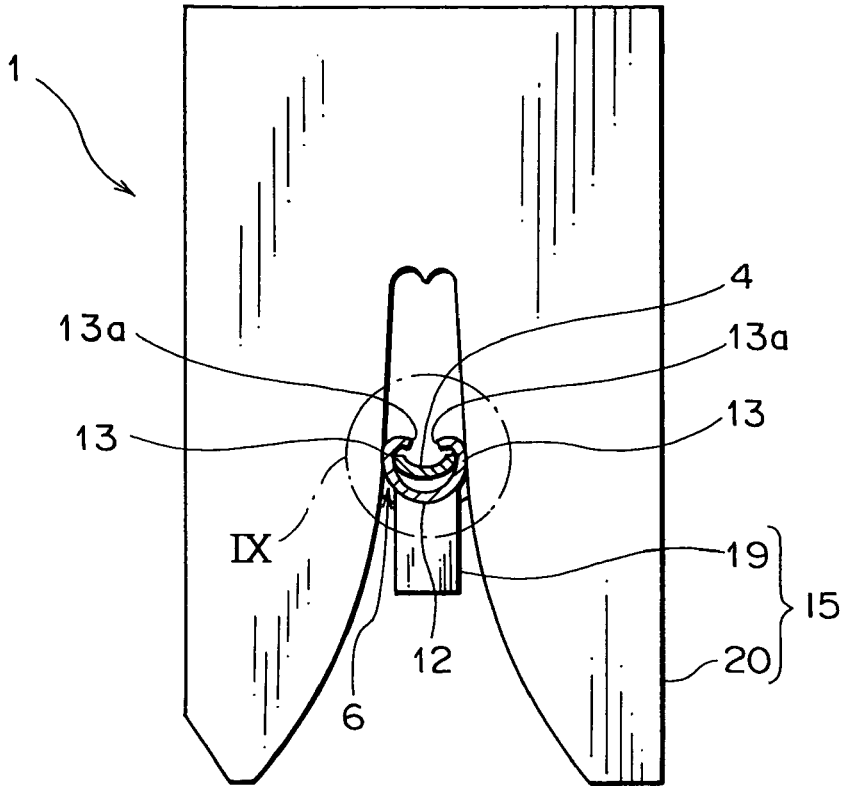
FIG. 8 is a view illustrating a state when an anvil and crimper shown in FIG. 7 approach each other.

Thereafter, the rod 24 of the air cylinder 17 extends. Then, as shown in FIG. 8, the crimper 20 approaches the anvil 19 so that the pair of the conductor caulking pieces 13 is put in the groove 20*a*. Since the width of the groove 20*a* becomes small in the direction parting away from the anvil 19, therefore when the crimper 20 approaches the anvil 19, the groove 20*a* effects deformation load application K (shown in FIG. 9) to the pair of the conductor caulking pieces 13 so that the conductor caulking pieces 13 approach each other. That is, the conductor caulking pieces 13 are deformed in such a manner that the conductor caulking pieces 13 are brought close to each other.

Figure 9:
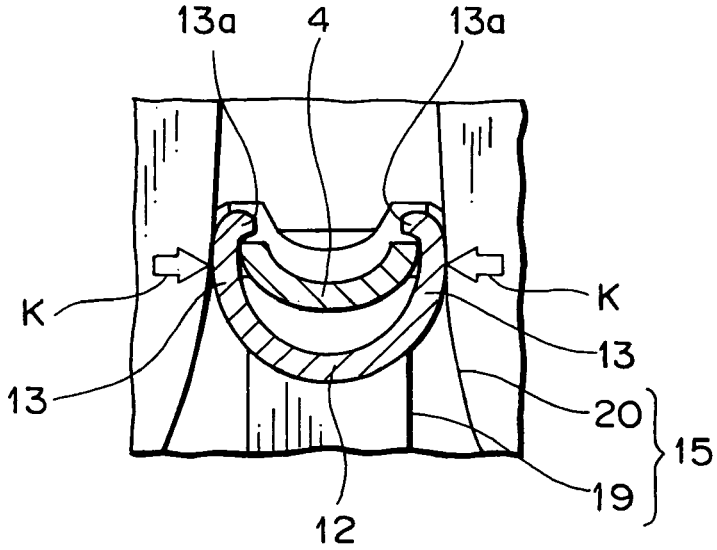
FIG. 9 is an enlarged view of a part IX in FIG. 8.
Figure 10:
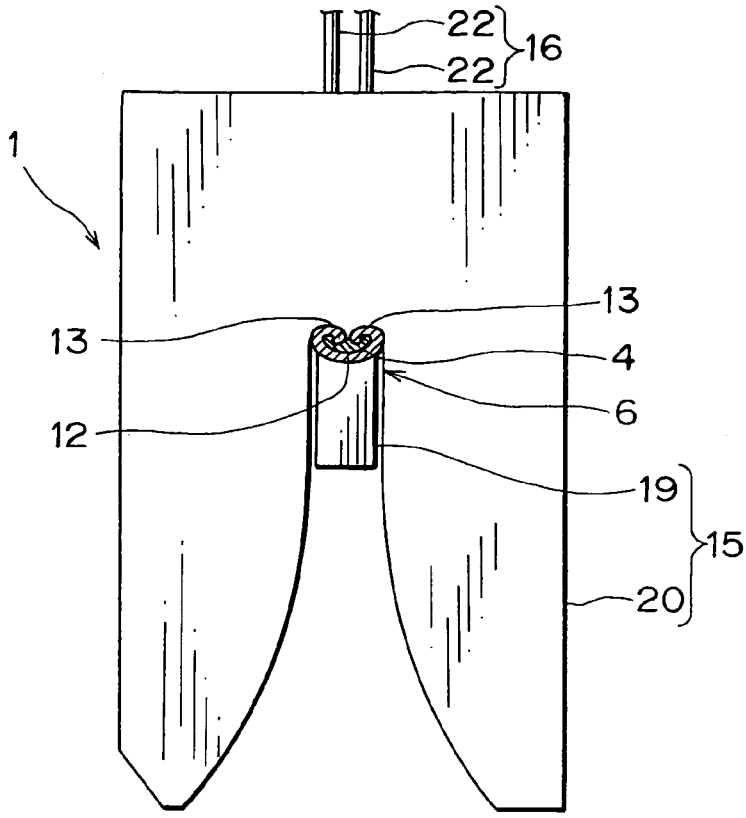
FIG. 10 is a view illustrating a state when the terminal fitting and the conductor of the FFC are held between the anvil and crimper shown in FIG. 7.

The deformation load application K is also transmitted to the conductor 4 through the pair of the conductor caulking pieces 13. At that time, the fastening projections 13*a* act as a stopper and as shown in FIG. 9, the pair of the conductor caulking pieces 13 and both ends in the width direction of the conductor 4 press to each other, so that the conductor 4 is bent along the bottom wall 12 without coming off from between the pair of the conductor caulking pieces 13. Then, as shown in FIG. 10, the terminal fitting 6 and the conductor 4 of the FFC 2 are put between the anvil 19 and the crimper 20 so as to allow the caulking pieces 13 and 14 to caulk the conductor 4 and the coating 5, respectively, so that the terminal fitting 6 is attached to the FFC 2. Finally, as shown in FIG. 11, the conductor 4 is press-fit to the terminal fitting 6 on a condition that the conductor 4 comes in close contact with the bottom wall 12.

Figure 11:
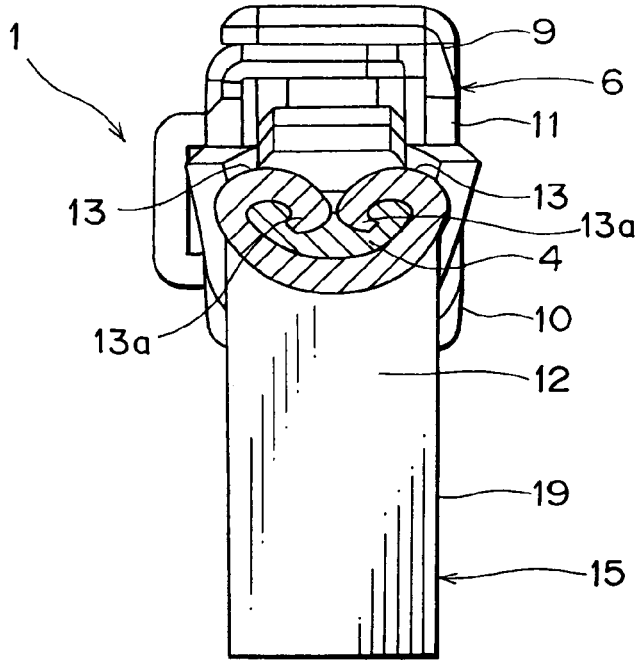
FIG. 11 is a view illustrating the terminal fitting attached to the FFC shown in FIG. 10.

Then, the rod 24 of the air cylinder 17 contracts toward the cylinder body 23 so that the anvil 19 and the crimper 20 part away from each other and the terminal fitting 6 is removed from the anvil 19 shown in FIG. 11.

Thereafter, a next terminal fitting 6 is placed on the anvil 19, then a next conductor 4 of the FFC 2 is positioned above the bottom wall 12 of the terminal fitting 6 and then, the terminal fitting 6 is attached to the FFC 2 as described above.

In the first preferred embodiment, when the pair of the conductor caulking pieces 13 is allowed to caulk, the fastening projection 13*a* acts as a stopper, thereby preventing the conductor 4 from coming off from between the pair of the conductor caulking pieces 13. Therefore, even if the conductor 4 is deformed in a shape in accordance with the bottom wall 12 by allowing the pair of the conductor caulking pieces 13 to caulk, the conductor 4 never comes off from between the pair of the conductor caulking pieces 13, thereby preventing the positional shift between the terminal fitting 6 and the conductor 4 from occurring.

Thus, even if the conductor 4 is not in advance deformed in a shape in accordance with the bottom wall 12 before the positioning, the conductor 4 can be deformed in a shape in accordance with the bottom wall 12, thereby attaining a stable press-fitting. Therefore, the number of molds for use in attaching the terminal fitting 6 to the conductor 4 can be prevented from increasing. That is, the cost of the attaching process can be prevented from increasing and the terminal fitting 6 can be securely attached to the conductor 4 of the FFC 2.

In the first preferred embodiment, each conductor caulking piece 13 is provided with the fastening projection 13*a*. Therefore, when the pair of the conductor caulking pieces 13 is allowed to caulk, the conductor 4 never comes off from between the pair of the conductor caulking pieces 13, therefore the terminal fitting 6 can be securely attached to the conductor 4 of the FFC 2.

In the first preferred embodiment, the distance W1 between the fastening projections 13*a* is smaller than the width W2 of the conductor 4. Therefore, even if a vibration takes place after the conductor 4 is positioned on the bottom wall 12 between the pair of the conductor caulking pieces 13, the conductor 4 never comes off from between the pair of the conductor caulking pieces 13.

In the first preferred embodiment, the fastening projections 13*a* are formed by bending the edges of the pair of the conductor caulking pieces 13, each edge being on the side situated away from the bottom wall 12. Therefore, the conductor 4 never comes off from between the edges.

The fastening projections 13*a* can be formed over the whole length of the respective conductor caulking pieces 13 in the longitudinal direction of the bottom wall 12.

In the first preferred embodiment, the conductor 4 is inserted into between the pair of the conductor caulking pieces 13 from between both edges of the pair of the conductor caulking pieces 13, said each edge being on the side situated away from the electric contact part 9, then the pair of the conductor caulking pieces 13 caulks the conductor 4 so as to crimp the conductor 4. Therefore, even if the distance W1 between the fastening projections 13*a* formed on the pair of the conductor caulking pieces 13 is smaller than the width W2 of the conductor 4, the conductor 4 can be easily positioned above the bottom wall 12 between the pair of the conductor caulking pieces 13. Therefore, positioning of the conductor 4 above the bottom wall 12 can be easily carried out.

In the first preferred embodiment, since the fastening projections 13*a* are provided, therefore the surface area of the conductor caulking pieces 13 becomes large. Therefore, the contact area between the conductor caulking pieces 13 and the conductor 14 becomes large when the conductor caulking pieces 13 are attached to the conductor 4, thereby improving reliability of the contact.

The Second Preferred Embodiment

In the following, the second preferred embodiment of the present invention will be explained with reference to FIGS. 12-17. Similarly to the first preferred embodiment, a terminal fitting 6 includes an electric contact part 9 and an electric wire connecting part 10.

Figure 12:
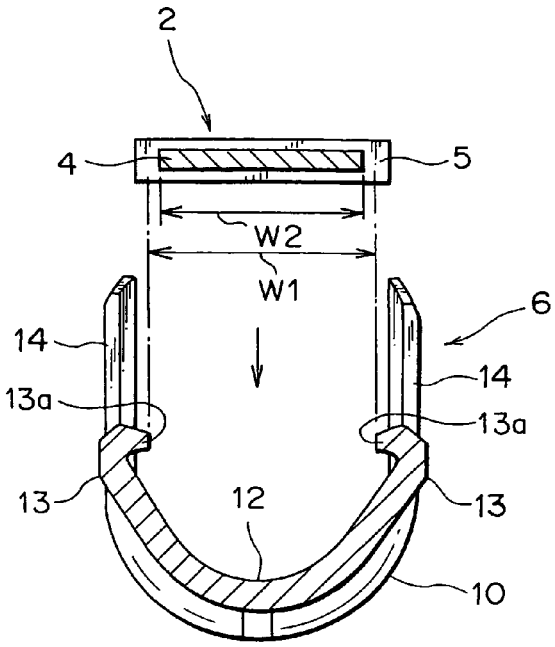
FIG. 12 is a cross sectional view taken along XII-XII line in FIG. 1 illustrating the second preferred embodiment of a terminal fitting and conductor.

As shown in FIG. 12, the second preferred embodiment is different from the first preferred embodiment in a point that a distance W1 between the fastening projections 13*a* is larger than a width W2 of the conductor 4 (that is, W1>W2). The same press-fitting device 1 shown in FIG. 7 is used. In the following, it is explained how the terminal fitting 6 is attached to the conductor 4. First, the terminal fitting 6 is placed on the anvil 19 on a condition that the anvil 19 and the crimper 20 are parted from each other.

Figure 13:
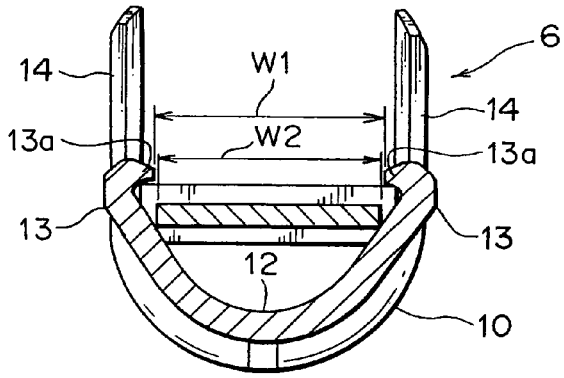
FIG. 13 is a cross sectional view illustrating a state when the conductor is positioned on a bottom wall of the terminal fitting shown in FIG. 12.
Figure 14:
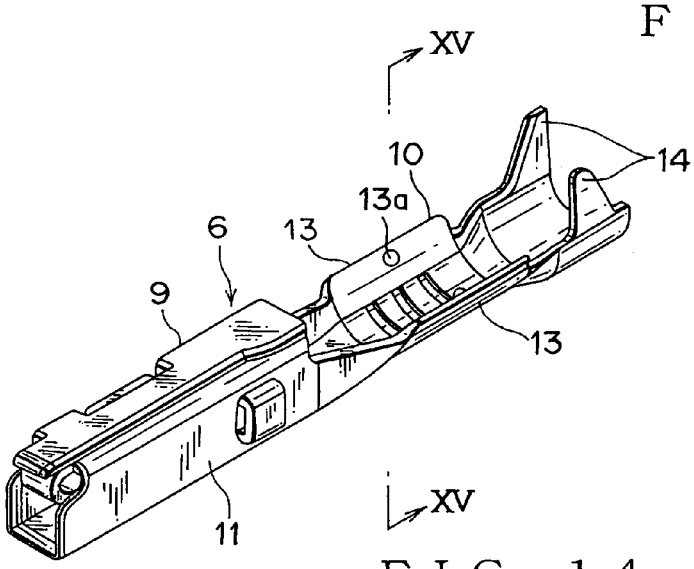
FIG. 14 is a perspective view illustrating a terminal fitting according to a further preferred embodiment of the present invention.
Figure 15:
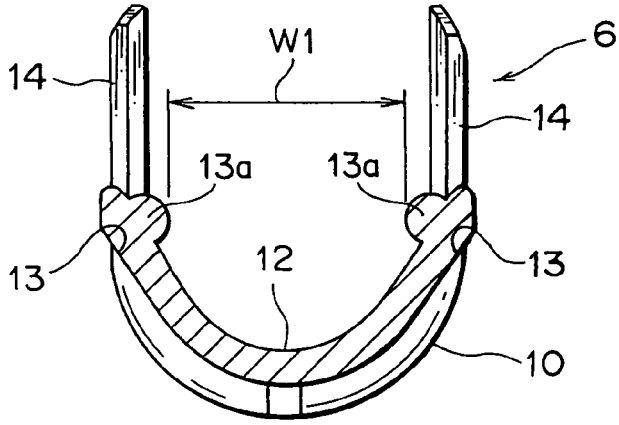
FIG. 15 is a cross sectional view taken along XV-XV line in FIG. 14.

Then, the conductor 4 of the FFC 2 is moved in a direction of an arrow in FIG. 12 so that the conductor 4 is inserted into the pair of the conductor caulking pieces 13 from edges of the pair of the conductor caulking pieces 13, said edge being on the side situated away from the bottom wall 12. At that time, the coating 5 is also inserted into the pair of the coating caulking pieces 14 from edges of the pair of the coating caulking pieces 14, said edge being on the side situated away from the bottom wall 12. As a result, as shown in FIG. 13, the conductor 4 is positioned above the bottom wall 12 and below the fastening projections 13*a* between the pair of the conductor caulking pieces 13.

Thereafter, the rod 24 of the air cylinder 17 extends. Then, the crimper 20 approaches the anvil 19, so that the pair of the conductor caulking pieces 13 is put in the groove 20*a* of the crimper 20. The groove 20*a* effects deformation load application K to the pair of the conductor caulking pieces 13 so that the conductor caulking pieces 13 approach each other. That is, the conductor caulking pieces 13 are deformed in such a manner that the conductor caulking pieces 13 are brought close to each other. The conductor 4 is moved in a direction in which the conductor 4 approaches the fastening projections 13*a* in response to the deformation. When the conductor caulking pieces 13 are deformed in such a manner that the conductor caulking pieces 13 are brought close to each other, the distance W1 between the pair of the fastening projections 13*a* becomes smaller than the width W2 of the conductor 4.

Similarly to the first preferred embodiment, the deformation load application K is transmitted to the conductor 4 through the pair of the conductor caulking pieces 13. At that time, the fastening projections 13*a* act as a stopper, so that the conductor 4 is bent along the bottom wall 12 without coming off from between the pair of the conductor caulking pieces 13. Then, as shown in FIG. 10, the terminal fitting 6 and the conductor 4 of the FFC 2 are put between the anvil 19 and the crimper 20 so as to allow the caulking pieces 13 and 14 to caulk the conductor 4 and the coating 5, respectively, so that the terminal fitting 6 is attached to the FFC 2. Finally, as shown in FIG. 11, the conductor 4 is press-fit to the terminal fitting 6 on a condition that the conductor 4 comes in close contact with the bottom wall 12.

Then, the rod 24 of the air cylinder 17 contracts toward the cylinder body 23 so that the anvil 19 and the crimper 20 part away from each other and the terminal fitting 6 is removed from the anvil 19 shown in FIG. 11.

Thereafter, a next terminal fitting 6 is placed on the anvil 19, then a next conductor 4 of the FFC 2 is positioned above the bottom wall 12 of the terminal fitting 6 and then, the terminal fitting 6 is attached to the FFC 2 as described above.

In the second preferred embodiment, the distance W1 between the fastening projections 13*a* is larger than the width W2 of the conductor 4. Therefore, the conductor 4 of the FFC 2 can be inserted from the edges of the pair of the conductor caulking pieces 13, said each edge being on the side situated away from the bottom wall 12, and can be positioned above the bottom wall 12 through between the fastening projections 13*a*. That is, the conductor 4 can be more easily positioned above the bottom wall 12.

In the first and second preferred embodiments, it might be hard to form the fastening projections 13*a* by bending the edges of the pair of the conductor caulking pieces 13, said each edge being on the side situated away from the bottom wall 12. Therefore, the fastening projections 13*a* may be formed in such a manner that the edges of the conductor caulking pieces 13 are extruded in a direction in which the conductor caulking pieces 13 approach each other by using a pressing machine. In an example shown in FIGS. 14 and 15, the edges of the conductor caulking pieces 13 are extruded to form hemisphere-shaped fastening projections 13*a* (i.e. indention). A plurality of the pair of the hemisphere-shaped fastening projections 13*a* may be formed along the longitudinal direction of the bottom wall 12.

Figure 16:
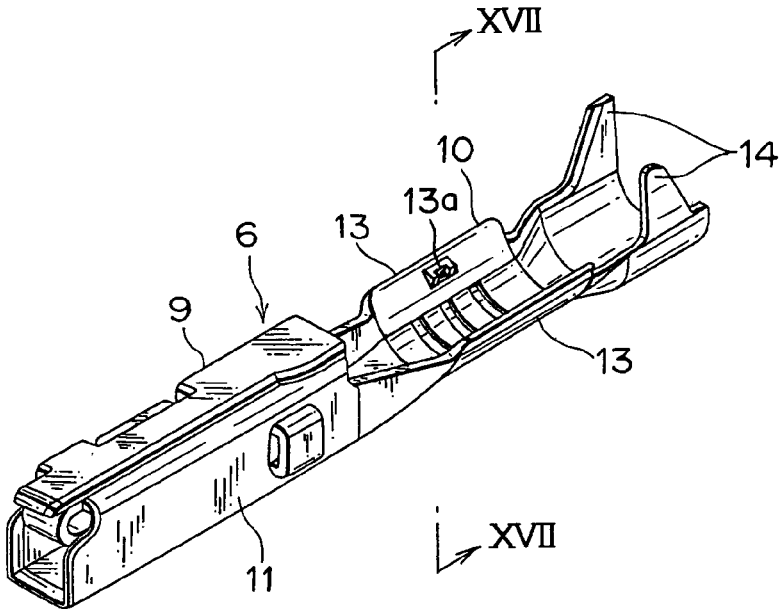
FIG. 16 is a perspective view illustrating a terminal fitting according to a still further preferred embodiment of the present invention.
Figure 17:
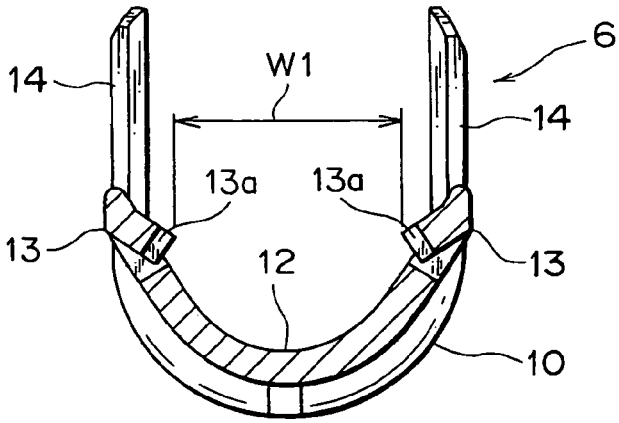
FIG. 17 is a cross sectional view taken along XVII-XVII line in FIG. 16.

In FIGS. 16 and 17, there are also shown an example in which the fastening projections 13*a* are formed by extruding. In this case, a mold of a pressing machine is allowed to penetrate through the conductor caulking piece 13 to form a rectangular shaped slit. The side of a portion of the conductor caulking piece 13 corresponding to the slit, said side of the portion being situated away from the bottom wall 12, is not notched from the conductor caulking piece 13. In this case, the portion of the conductor caulking piece 13 corresponding to the slit is extruded to be the fastening projection 13*a*. A plurality of the pair of the fastening projections 13*a* shown in FIGS. 16 and 17 may be formed along a longitudinal direction of the bottom wall 12. Since such fastening projections 13*a* formed by extruding can be formed in a normal terminal manufacturing process, therefore a cost-up of a terminal fitting 6 can be prevented from occurring.

A distance W1 between the pair of the fastening projections 13*a* formed by extruding shown in FIGS. 14-17 may be formed smaller than the width W2 of the conductor 4 similarly to the first preferred embodiment or may be formed larger than the width W2 of the conductor 4 similarly to the second preferred embodiment.

In the examples shown in FIGS. 14-17, the fastening projections 13*a* are not formed over the whole length of the conductor caulking piece 13 along the longitudinal direction of the bottom wall 12. However, instead, the fastening projections 13*a* may be formed over the whole length of the conductor caulking piece 13 along the longitudinal direction of the bottom wall 12, so that when the conductor 4 is inserted from the edges of the conductor caulking piece 13, said edges being on the side situated away from the electric contact part 9, the conductor 4 can be inserted into between the pair of the conductor caulking pieces 13 along such fastening projections 13*a*, so that the positioning of the conductor 4 is easy.

The aforementioned preferred embodiments are described to aid in understanding the present invention and variations may be made by one skilled in the art without departing from the spirit and scope of the present invention.

What is claimed is:

1. A terminal fitting comprising:

an electric contact part to be connected to a mating terminal fitting;

an electric wire connecting part including a bottom wall and a pair of caulking pieces rising up from the bottom wall, the pair of the caulking pieces caulking a conductor of a flat circuit body on a condition that the conductor is positioned above the bottom wall between the pair of the caulking pieces, thereby the electric wire connecting part crimping the conductor; and preventing means for preventing the conductor from coming off from between the pair of the caulking pieces, the preventing means consisting of fastening projections, formed by bending an edge of each caulking piece, each of which projects from the caulking piece, prior to crimping thereof, in a direction in which the pair of the caulking pieces approaches each other.

2. The terminal fitting according to claim 1, wherein the fastening projections are formed at both edges of the pair of the caulking pieces, said each edge being on the side situated away from the bottom wall.

3. The terminal fitting according to claim 2, wherein a distance between the fastening projections, prior to crimping thereof, is smaller than a width of the conductor.

4. The terminal fitting according to claim 2, wherein a distance between the fastening projections is larger than a width of the conductor.

5. The terminal fitting according to claim 2, wherein the fastening projections are formed by bending the edges of the pair of the caulking pieces, said each edge being on the side situated away from the bottom wall.

6. The terminal fitting according to claim 2, wherein the fastening projections are formed by extruding the edges of the caulking pieces in a direction in which the pair of the caulking pieces approaches each other.

* * * * *